US009082378B2

(12) United States Patent
Miyashita

(10) Patent No.: US 9,082,378 B2
(45) Date of Patent: Jul. 14, 2015

(54) SUPPORTING STRUCTURE FOR ELECTRONIC PAD OF PERCUSSION INSTRUMENT

(71) Applicant: YAMAHA CORPORATION, Hamamatsu-shi, Shizuoka-ken (JP)

(72) Inventor: Shinya Miyashita, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/205,502

(22) Filed: Mar. 12, 2014

(65) Prior Publication Data

US 2014/0260897 A1 Sep. 18, 2014

(30) Foreign Application Priority Data

Mar. 14, 2013 (JP) ..... 2013-051841

(51) Int. Cl.
*G10D 13/06* (2006.01)
*G10H 1/32* (2006.01)

(52) U.S. Cl.
CPC ..... *G10D 13/065* (2013.01); *G10D 13/06* (2013.01); *G10H 1/32* (2013.01)

(58) Field of Classification Search
USPC ..... 84/723, 422.3
IPC ..... G01D 13/965
See application file for complete search history.

(56) References Cited

U.S. PATENT DOCUMENTS

| | | | | |
|---|---|---|---|---|
| 5,969,281 | A | 10/1999 | Suenaga | |
| 8,742,244 | B2 * | 6/2014 | Wissmuller | 84/723 |
| 8,785,758 | B2 * | 7/2014 | Wissmuller | 84/615 |
| 2010/0005948 | A1 * | 1/2010 | Romolino | 84/422.3 |
| 2011/0056361 | A1 * | 3/2011 | Steele | 84/422.3 |
| 2012/0048099 | A1 * | 3/2012 | Wissmuller | 84/723 |
| 2012/0118130 | A1 * | 5/2012 | Field | 84/730 |
| 2013/0012279 | A1 * | 1/2013 | McCauley et al. | 463/7 |
| 2013/0047826 | A1 * | 2/2013 | Wissmuller | 84/723 |
| 2014/0116229 | A1 * | 5/2014 | Mori | 84/415 |

FOREIGN PATENT DOCUMENTS

JP 2009-128800 A 6/2009

* cited by examiner

*Primary Examiner* — David Warren
(74) *Attorney, Agent, or Firm* — Rossi, Kimms & McDowell LLP

(57) ABSTRACT

A supporting structure for an electronic pad of a percussion instrument includes a pad member, a pair of a first engaging part and a second engaging part, and a connecting part which connects a first object (e.g. a leg fixed to a stand) and a second object (e.g. the second engaging part) in a rotatable manner about the rotation center. The connecting part includes a rotation-regulating unit which regulates the rotational displacement of the second object within the regulation range irrespective of a rotational torque less than a predetermined value which is applied to the second object disposed at the initial position relative to the first object. Due to a rotational torque above the predetermined value, the rotation-regulating unit shifts the regulation range so as to shift the initial position, and therefore the second object will be restored to the new initial position.

5 Claims, 9 Drawing Sheets

SUPPORTING STRUCTURE FOR ELECTRONIC PAD OF PERCUSSION INSTRUMENT

BACKGROUND OF THE INVENTION

1. Field of the Invention

The present invention relates to a supporting structure for an electronic pad of a percussion instrument.

The present application claims priority on Japanese Patent Application No. 2013-51841, the entire content of which is incorporated herein by reference.

2. Description of the Related Art

Conventionally, percussion instruments including as electronic cymbals or electronic high-hat cymbals are equipped with electronic pads serving as electronic cymbals instead of acoustic cymbals. Impact sensors are installed in electronic pads so as to detect impacts applied to electronic pads, thus generating electric signals which are used to generate musical sounds. When excessive rotational displacements unexpectedly occur in electronic pads, wiring cords may be caught by some parts of percussion instruments, or striking positions of electronic pads may be significantly deviated from the positions of impact sensors, thus degrading detection precisions of impact sensors. For this reason, engineers have devised supporting structures including rotary stopper mechanisms for electronic pads of percussion instruments.

Patent Literature Document 1 (PLT 1) discloses an electronic pad of a percussion instrument with a rotation stop hole and a rotation stop pin arranged in the support section of a high-hat pad body. Patent Literature Document 2 (PLT 2) discloses a holder for a percussion musical instrument with a rotation-preventing assembly which is used to prevent rotation of a percussion musical instrument such as a cymbal.

In the supporting structure of PLT 1, an engaging member such as a pin which is arranged in the support section of a pad body is engaged with an engaged part such as a hole which is formed in a pad body, thus regulating a rocking range of a pad body. A gap is formed between the engaging member and the engaged part to secure an adequate rocking range. This gap serving as a play allows a pad body to rotate in a rotating direction.

In the supporting structure of PLT 1, it is possible to regulate the rotation range within a certain range of play as long as a rotary force applied to a pad body falls within a certain range of force during performance of a percussion instrument. When an excessive rotary force is applied to a pad body, an excessive load may be applied to either the fitting member or the fitted part, thus causing a failure or damage in a percussion instrument. To prevent a failure or damage occurring in a percussion instrument, it is necessary to implement any measures, for example, in which engagement-related parts are made of highly-rigid materials such as metals; but this may increase the overall weight of a percussion instrument or the manufacturing cost thereof.

During performance of an electronic pad with a stick, a player (or a user) may not always swing a stick down towards a pad body in a vertical direction but may swing a stick in a slanted direction or a horizontal direction. This playing technique may cause a pad body to excessively rotate with a relatively large angle. The electronic pad of PLT 1 is equipped with the supporting structure which suddenly stops rotation of a pad body at a rotation-regulated position; this may cause unnatural movement of a pad body, or a player may feel discomfort in striking a pad body with a stick. Additionally, it is necessary to consider rotary forces which may be applied to pad bodies during manufacturing and adjustments of percussion instruments in addition to rotary forces which are applied to pad bodies during performance of percussion instruments.

CITATION LIST

Patent Literature

Patent Literature Document 1: Japanese Patent Application Publication No. 2009-128800

Patent Literature Document 2: U.S. Pat. No. 5,969,281

SUMMARY OF THE INVENTION

It is an object of the present invention to provide a supporting structure which prevents a failure or damage occurring on an electronic pad of a percussion instrument due to an excessive force applied to an electronic pad in a rotating direction.

The present invention is directed to a percussion instrument which generates an electronic musical sound in response to a striking operation applied to an electronic pad resembling a cymbal with a stick.

In a first aspect of the present invention, a supporting structure for an electronic pad of a percussion instrument includes a pad member, a first engaging part, a second engaging part, and a connecting part. The pad member is supported by a support member in a rotatable manner about the rotation center and subjected to a striking operation. The first engaging part is arranged independently of the pad member or is unified with the pad member. The second engaging part is engaged with the first engaging part. The second engaging part is arranged independently of the support member or is unified with the support member. The second engaging part is pressed to rotate about the rotation center via the first engaging part in response to a rotary force applied to the pad member. The connecting part establishes at least one of a connection between the pad member and the first engaging part or a connection between the support member and the second engaging part. The connecting part connects a first object and a second object to relatively rotate about the rotation center. The connecting part includes a reaction generator which generates a reactive force against a rotary force by which the second object disposed at the initial position relative to the first object is displaced from the initial position in a rotating direction. When the rotary force is released, the connecting part allows the second object to be restored to the initial position, thus disappearing the reactive force generated by the reaction generator.

In the above, the reactive force becomes larger as the rotational displacement of the second object from the initial position becomes larger.

Preferably, the connecting part includes a rotation-regulating unit which regulates the rotational displacement of the second object within the predetermined regulation range when a rotational torque less than the predetermined value is applied to the second object disposed at the initial position relative to the first object. When a rotational torque above the predetermined value is applied to the second object disposed at the initial position, the rotational displacement of the second object becomes higher than the predetermined regulation range, thus shifting the regulation range of the rotation-regulating unit. When the rotational torque above the predetermined value is released, the rotation-regulating unit allows the second object to be restored to a new initial position which is shifted from the initial position.

In a second aspect of the present invention, a supporting structure for an electronic pad of a percussion instrument includes a pad member, a first engaging part, a second engaging part, and a connecting part. The pad member is supported by a support member in a rotatable manner about the rotation center and subjected to a striking operation. The first engaging part is arranged independently of the pad member or unified with the pad member. The second engaging part is engaged with the first engaging part. The second engaging part is arranged independently of the support member or unified with the support member. The second engaging part is pressed to rotate about the rotation center via the first engaging part in response to a rotary force applied to the pad member. The connecting part establishes at least one of a connection between the pad member and the first engaging part or a connection between the support member and the second engaging part. The connecting part connects a first object and a second object to relatively rotate about the rotation center. The connecting part includes a rotation-regulating unit which regulates the rotational displacement of the second object within the predetermined regulation range when a rotational torque less than the predetermined value is applied to the second object disposed at the initial position relative to the first object. The second object is restored to the initial position when the rotational torque less than the predetermined value is released. When a rotational torque above the predetermined value is applied to the second object disposed at the initial position, the rotational displacement of the second object becomes higher than the predetermined regulation range, thus shifting the regulation range of the rotation-regulating unit. When the rotational torque above the predetermined value is released, the rotation-regulating unit allows the second object to be restored to a new initial position which is shifted from the initial position.

In the invention, it is possible to prevent a failure or damage occurring on an electronic pad which receives an excessive force in a rotating direction while preventing a player (or a user) from feeling discomfort in striking an electronic pad with a stick.

Since the present invention is designed to increase a rotation-regulating force in proportion to a force applied to an electronic pad in a rotating direction, it is possible to further prevent a failure or damage occurring on an electronic pad while preventing a player from feeling discomfort in striking an electronic pad with a stick.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1:
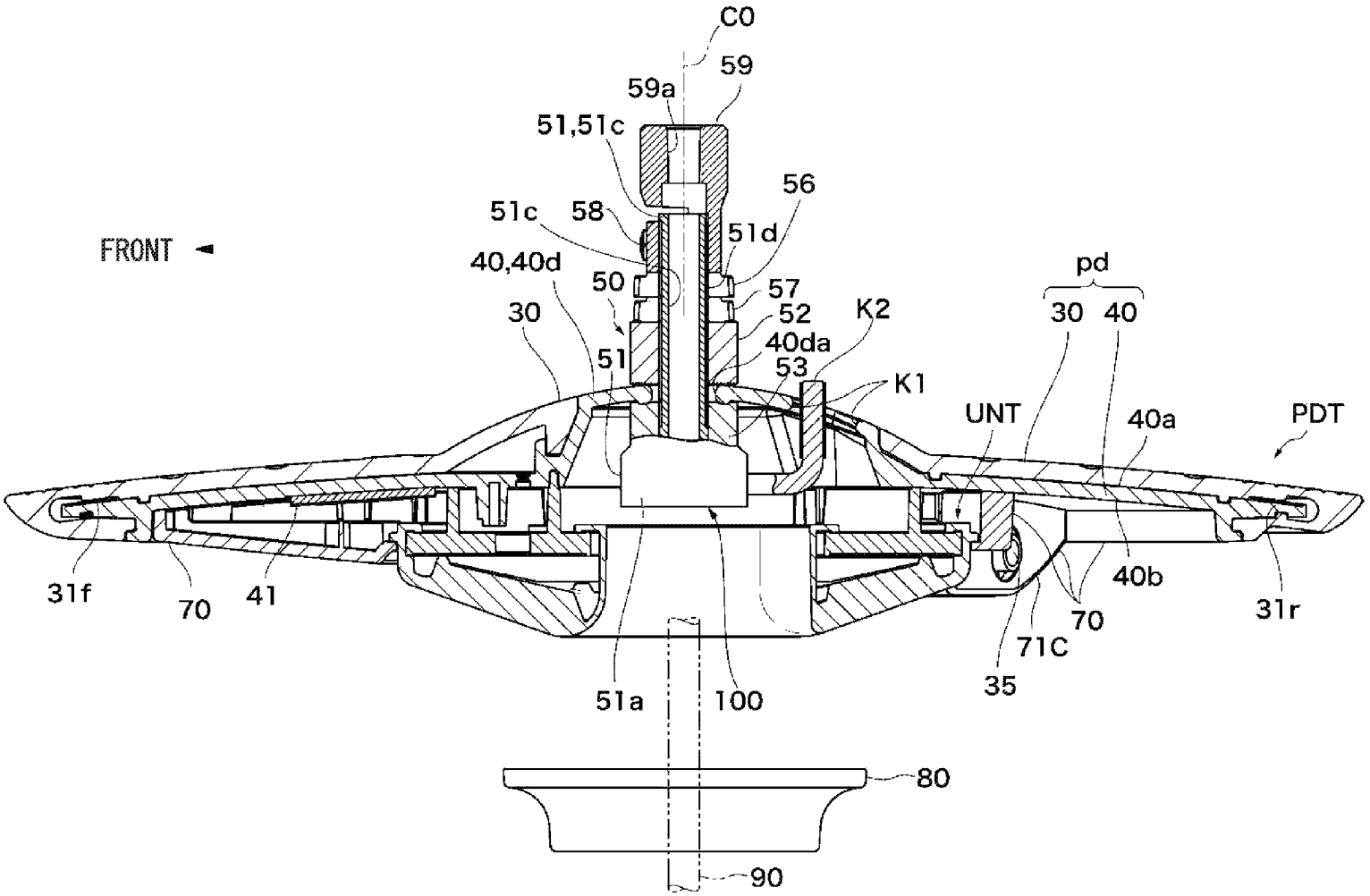
FIG. 1 is a cross-sectional view of an electronic pad of a percussion instrument equipped with a supporting structure according to the preferred embodiment of the present invention.

An electronic pad of the present embodiment can be designed as a high-hat electronic pad (which substitutes for a high-hat cymbal) or a cymbal-shaped electronic pad. FIG. 1 shows an electronic pad which resembles a high-hat cymbal and which includes a high-hat pad body PDT and a bottom base 80. The high-hat pad body PDT and the bottom base 80 have circular shapes in a plan view. Specifically, the high-hat pad body PDT resembles a top cymbal while the bottom base 80 resembles a bottom cymbal in an acoustic high-hat cymbal.

Figure 2B:
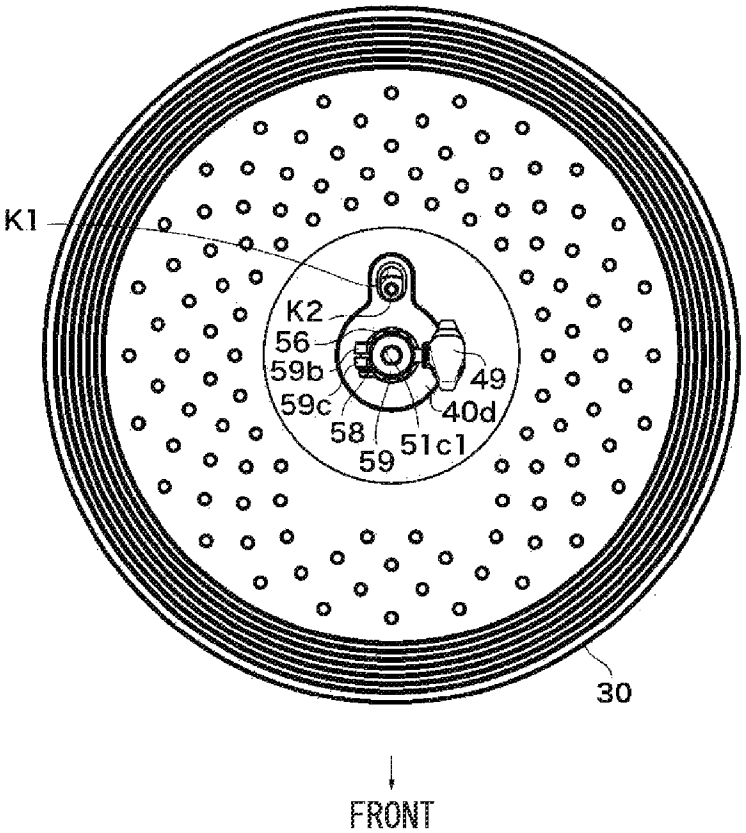
FIG. 2B is a plan view of the high-hat pad body included in the electronic pad shown in FIG. 1.
Figure 2A:
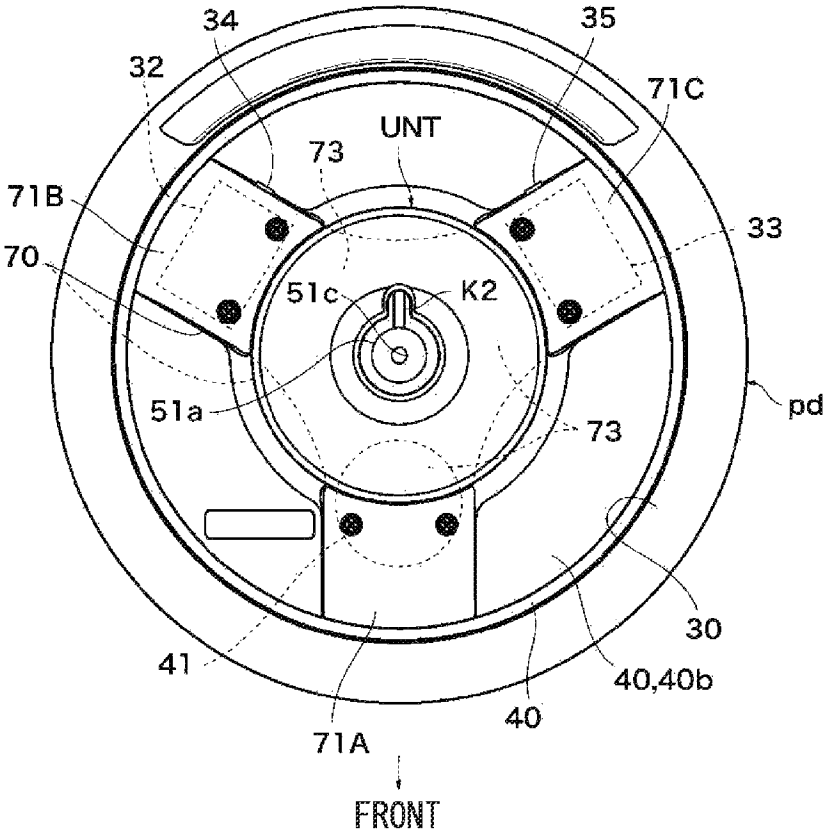
FIG. 2A is a bottom view of a high-hat pad body included in the electronic pad shown in FIG. 1.

FIG. 2A is a bottom view of the high-hat pad body PDT while FIG. 2B is a plan view of the high-hat pad body PDT. The following description refers to the electronic pad which is supported horizontally, wherein the player' side will be referred to as "FRONT" while "RIGHT" and "LEFT" are viewed in the player's side. In this connection, FIG. 1 and FIGS. 2A, 2B show a high-hat electronic pad.

The outline of the high-hat pad body PDT will be described below. As shown in FIG. 1, the high-hat pad body PDT includes a pad member pd, a rear cover 70, and an operation detection unit UNT. The pad member pd includes a frame 40 and a rubber pad 30 serving as a strike surface of an electronic pad which is struck with a stick (not shown). The frame 40 is made of a hard material such as polypropylene (PP) which may convert a vibration into an internal loss while absorbing deflection of the frame 40 which occurs when the pad member pd is intensively struck with a stick. The rear cover 70 is made of a softer material, such as ethylene-vinyl acetate (EVA) resin, than the frame 40. The rear cover 70 may be deformed along with deflection of the frame 40, thus suppressing a vibration which occurs when the pad member pd is struck with a stick.

The high-hat pad body PDT is supported horizontally by a support member 50 in a freely-rocking manner. The support member 50 is fixed to a "movable" leg 90 which is vertically disposed on a stand (not shown). The leg 90 is descended down along with a depressing operation which is applied to a pedal (not shown) by a player's foot. Upon releasing a depressing operation on a pedal, the leg 90 is ascended up by means of a pressing mechanism (not shown). Therefore, the support member 50 is moved up or down together with the leg 90 which is moved up or down due to an operation of a pedal (hereinafter, simply referred to as a "pedal operation").

In addition to a striking operation applied to the upper face of the high-hat pad body PDT, the percussion instrument of the present embodiment accommodates a specific pedal operation, which is specifically employed by a high-hat cymbal, in which the operation detection unit UNT of the high-hat pad body PDT is brought into contact with the bottom base 80.

As shown in FIG. 1, the support member includes a rotation-regulating unit 100, felts 52, 53, nuts 56, 57, and a leg-fixing member 59, which are integrally unified together. The rotation-regulating unit 100 includes a second engaging part K2 in addition to a base 51 which is fixed to the leg 90. The second engaging part K2 has an L-shape in a side view, in which the distal end thereof is extended upwardly and vertically. The vertically-extended portion of the second engaging part K2 is covered with a cushioning material such as vinyl chloride. The base 51 includes a mounting base 51*a* and a felt support 51*c*. The detailed configuration of the rotation-regulating unit 100 will be described later with reference to FIGS. 3A, 3B and FIG. 4.

A through-hole 40*da* and a first engaging part K1 are formed in a supported part 40*d* which is formed in the center area of the frame 40 in a radius direction. An insertion hole 51*c*1 which the leg 90 is inserted into is formed to run through the felt support 51*c* in a vertical direction. An external thread 51*d* is formed in the external periphery of the felt support 51*c*. The felt support 51*c* runs through the through-hole 40*da* of the supported part 40*d* of the frame 40 with a clearance. Therefore, the high-hat pad body PDT including the pad member pd is supported by the leg 90 about a rotation center C0 (which corresponds to an axial center of the insertion hole 51*c*1) via the support member 50 in a horizontal direction in a rotation-free manner.

Figure 3A:
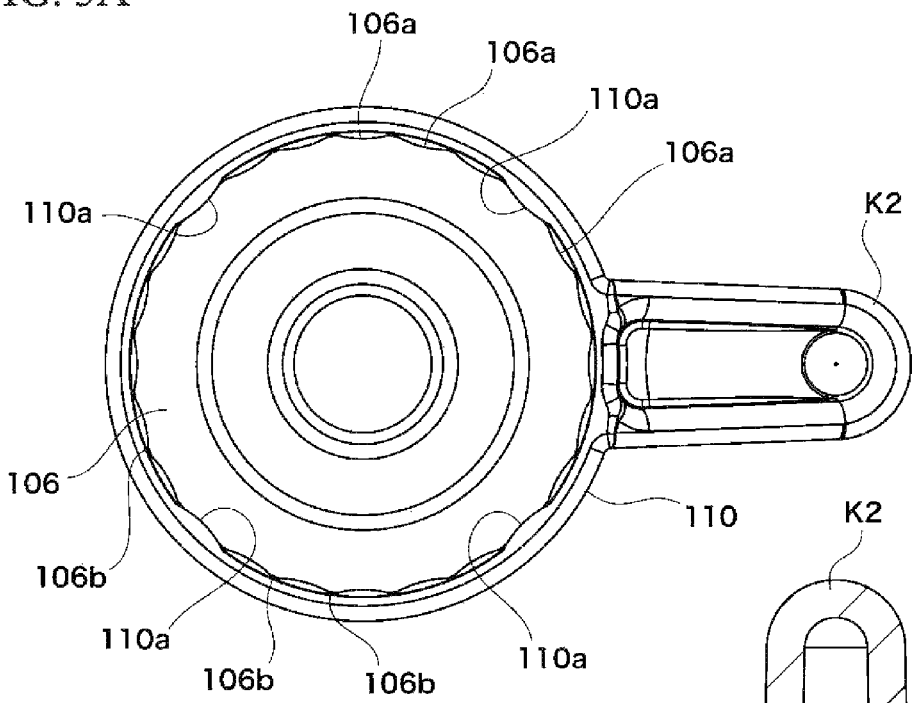
FIG. 3A is a rear view of a rotation-regulating unit which is installed in the high-hat pad body.
Figure 3B:
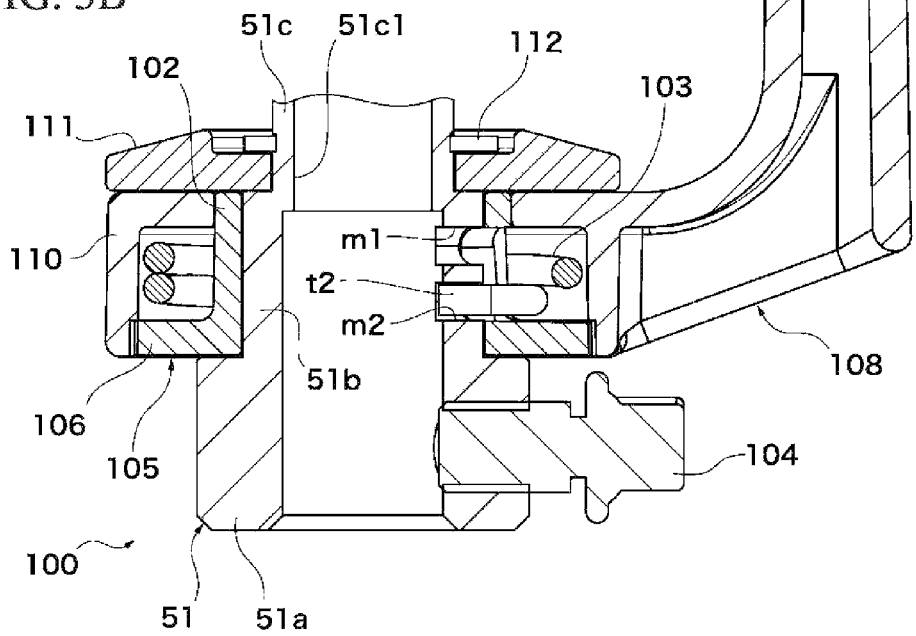
FIG. 3B is a cross-sectional view of the rotation-regulating unit.
Figure 4:
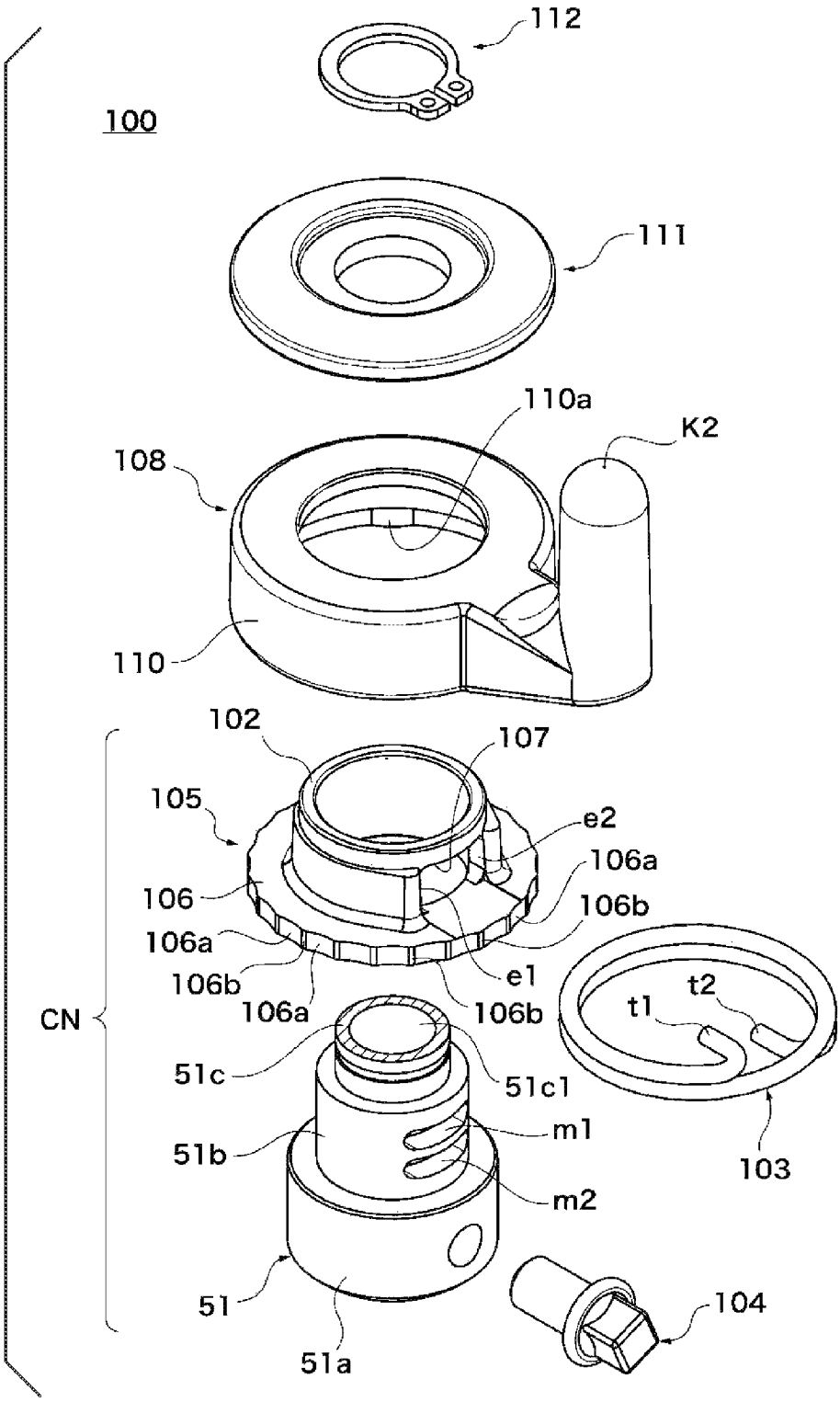
FIG. 4 is an exploded perspective view of the rotation-regulating unit.

The second engaging part K2 runs through the first engaging part K1 such that the upper portion thereof is exposed. The first engaging K1 is a through-hole which functions as a rotary stopper. Due to a rotating force applied to the pad member pd, the second engaging part K2 receives a pressing force which is exerted in a rotating direction about the rotation center C0 via the first engaging K1. Due to a very small rotation torque applied to the pad member pd, it is possible to regulate a rotation angle range of the high-hat pad member PDT within a range of play between the second engaging part K2 and the first engaging K1 since the second engaging part K2 comes in contact with the left and right sides of the interior wall of the first engaging K1. Due to a high rotation torque applied to the pad member pd, the second engaging part K2 can be subjected to rotational displacement relative to the base 51 as shown in FIGS. 3A, 3B and FIG. 4.

The doughnut-shaped felts 53, 52 are sequentially attached to the support member 50 above the mounting base 51*a* at the predetermined positions sandwiching the supported part 40*d* of the frame 40. The felt support 51*c* is inserted into the holes of the felts 53, 52. The nuts 56, 57 (in which the nut 56 is not necessarily essential but used to prevent loosening) are engaged with the external thread 51*d* of the felt support 51*c* above the felt 52. By applying an appropriate force between the nut 57 and the mounting base 51*a*, it is possible to tightly hold the felts 52, 53 above and below the supported part 40*d* of the frame 40. This makes it possible for the high-hat pad body PDT to be rocked about the felt support 51*c* via the "elastic" felts 52, 53. Owing to the engagement between the second engaging part K2 and the first engaging K1, it is possible to regulate a rocking angle range of the high-hat pad body PDT.

The leg-fixing member 59 is divided into an upper portion and a lower portion via a horizontal slot (not shown). A vertical slot (not shown) is arranged in the lower portion of the leg-fixing member 59, thus forming a pair of fastening elements 59*b*, 59*c* which are positioned close to each other (see FIG. 2B). An internal thread (not shown) which matches with the external thread 51*d* of the felt support 51*c* is formed inside the lower portion of the leg-fixing member 59 in a radius direction. The lower portion of the leg-fixing member 59 is engaged with the upper end of the felt support 51*c* while a pair of fastening elements 59*b*, 59*c* is fastened via a screw 58 (see FIG. 1), thus fastening the upper end of the felt support 51*c* via the lower portion of the leg-fixing member 59. Thus, it is possible to fix the leg-fixing member 59 to the felt support 51*c*.

By fastening a knob 49 (see FIG. 2B) on the condition that the leg 90 is inserted into the insertion hole 59*a* in the upper portion of the leg-fixing member 59, it is possible to fixedly connect the support member 50 to the leg 90. Therefore, the support member 50 is moved up or down correspondingly along with the leg 90 which is moved up or down.

As shown in FIG. 1, the rubber pad 30 is adhered to the upper side of the frame 40 via a both-side adhesive tape or an adhesive. The periphery of the rubber pad 30 is wound about the frame 40 from the upper side to the lower side, whereby the rubber pad 30 is fixed in position such that the periphery of the frame 40 is vertically cramped by the rubber pad 30.

A pair of sheet sensors 31*f*, 31*r* is attached to an upper face 40*a* in the periphery of the frame 40 via an adhesive. Other sheet sensors (not shown) are arranged on the upper face 40*a* in the periphery of the supported part 40*d* of the frame 40 in a radius direction. These sheet sensors are film-shaped sensors which are able to independently output detection signals upon detecting pressure variations. As the sheet sensors, it is possible to employ any types of sensors such as piezoelectric sensors and capacitor sensors. A piezoelectric sensor 41 is attached to a rear face 40*b* of the frame 40 via an adhesive. As the piezoelectric sensor 41, it is possible to employ any types of configurations which can detect vibration by use of piezoelectric elements.

As shown in FIG. 2A, a pair of signal output parts 32, 33 is arranged in the rear face 40*b* of the frame 40. The piezoelectric sensor 41 is connected to the signal output part 32 via a signal line (not shown), wherein the signal output part 32 outputs a detection signal of the piezoelectric sensor 41 to an external device (not shown) via an output terminal 34. The leads (not shown) which are extended from the sheet sensors (31*f*, 31*r*, etc.) are electrically connected to the signal output part 32, and therefore detection signals of these sensors are output to an external device via the output terminal 34. The signal output part 33 outputs a detection signal of the operation detection unit UNT to an external device via an output terminal 35. Wiring cords (not shown) are connected to the output terminals 34, 35.

A percussion instrument including the electronic pad of the present embodiment is equipped with a musical sound generating apparatus which includes a CPU, a musical sound controller with a memory device, an effect circuit, a sound source circuit, and a sound system. The musical sound generating apparatus generates musical sounds, which are controlled by a CPU, based on detection signals output from the signal output parts 32, 33.

A main strike area is an area of the surface of the rubber pad 30 which is positioned close to the position of the piezoelectric sensor 41. Due to an impact applied to the rubber pad 30, a plurality of sensors selected from among the piezoelectric sensor 41 and the sheet sensors 31*f*, 31*r* etc. may concurrently output a plurality of detection signals. It is possible to arbitrarily set a percussion instrument as to which of sensor signals is used to control a musical sound. For example, it is possible to select a sensor signal representing the largest sound volume in controlling a musical sound. Additionally, it is possible to use the sheet sensors 31*f*, 31*r*, which are arranged in the periphery of the frame 40, in detecting a mute operation or in detecting a striking operation.

The rear cover 70 includes a base 73 and three arms 71 (i.e. 71A, 71B, 71C), all of which are integrally unified. The base 73 is formed in the center area of the rear cover 70 in a radius direction, while the arms 71 are extended from the base 73 in a radial manner. The rear cover 70 is attached to the rear face 40*b* of the frame 40 via screws or adhesives.

FIG. 3A is a rear view of the rotation-regulating unit 100 while FIG. 3B is a cross-sectional view of the rotation-regulating unit 100. FIG. 4 is an exploded perspective view of the rotation-regulating unit 100.

The rotation-regulating unit 100 includes an external member 108, a ring cover 111, a stopper 112, and a connecting part CN (see FIG. 4). The second engaging part K2 is integrally unified with the external member 108. The connecting part CN includes the base 51, a spring 103, a screw 104, and an intermediate member 105. In the present embodiment, the connecting part CN is connected to the leg 90 while the connecting part CN is connected to the external member 108 and the second engaging part K2, wherein the leg 90, the external member 108, and the second engaging part K2 are connected together such that they can rotate about the rotation center C0 relatively. All the base 51, the spring 103, the screw 104, and the stopper 112 are made of metals while other parts are made of hard resins.

As described above, the base 51 includes the mounting base 51*a* which is disposed at the lowermost position, the felt support 51*c* including the insertion hole 51*c*1, and an intermediate cylinder 51*b* which connects between the mounting base 51*a* and the felt support 51*c* (see FIG. 3B). The base 51 is fixed to the leg 90, which is inserted into the insertion hole 51*c*1, via the screw 104.

The external member 108 includes an external cylinder 110 from which the second engaging part K2 is projected outwardly. The upper portion of the second engaging part K2 is extended upwardly. Four projections 110*a* are formed along the interior circumference of the external cylinder 110 with equal spaces (see FIG. 3A).

The intermediate member 105 includes a horizontal flange 106 above which a cylindrical projection 102 is formed. A window opening 107 is formed in the cylindrical projection 102. The opposite ends of the window opening 107 in the circumferential direction are used as a first driver e1 and a second driver e2. A plurality of recesses 106*a*, which are inwardly recessed in a radius direction, is entirely formed on the external circumference of the flange 106 with equal spaces. A plurality of peaks 106*b* which are peaked outwardly is formed between a plurality of recesses 106*a* such that each peak 106*b* is formed between a pair of recesses 106*a* which are positioned adjacent to each other. The external arc-shape of the projection 110*a* is engaged with the internal arc-shape of the recess 106*a*. The number of the recesses 106*a* is an integral multiple of the number of the projections 110*a*. For example, it is possible to form twenty-four recesses 106*a* with equal angular spacing of 15°.

A pair of a first groove m1 and a second groove m2 which are vertically positioned in parallel is formed along the external circumference of an intermediate cylinder 51*b*. The spring 103 is formed by folding a single wire in a ring shape, the opposite ends of which are inwardly projected to form a first end t1 and a second end t2. The first end t1 and the second end t2 of the spring 103 are positioned vertically with the same vertical distance as the vertical distance between the first groove m1 and the second groove m2.

After assembling the rotation-regulating unit 100, the intermediate member 105 is engaged with the intermediate cylinder 51*b* while the flange 106 is brought into contact with the upper end of the mounting base 51*a* (see FIG. 3B). The spring 103 is wound about the external circumference of the cylindrical projection 102 of the intermediate member 105 on the condition that the grooves m1, m2 positionally match the window opening 107 of the cylindrical projection 102. At this time, the first end t1 and the second end t2 of the spring 103 are put into the first groove m1 and the second groove m2 of the intermediate cylinder 51*b* via the window opening 107 (see FIG. 3B).

In the above condition, the first end t1 and the second end t2 of the spring 103 are brought into contact with the first driver e1 and the second driver e2 of the window opening 107. Thus, the first end t1 and the second end t2 of the spring 103 are weakly pre-tensioned by the first driver e1 and the second driver e2 such that they will approach each other.

The external member 108 is mounted on the upper side of the connecting part CN which is assembled as described above. Herein, the projections 110*a* of the external cylinder 110 are engaged with the recesses 106*a* of the intermediate member 105 (see FIG. 3A). The projections 110*a* are positioned opposite to each other about the center of the external cylinder 110 in a radius direction. In a free condition, the diameter of a circle passing through the distal end of the projection 110*a* is identical to the diameter of a circle passing through the bottom of the recess 106*a* but smaller than the diameter of a circle passing through the distal end of the peak 106*b*.

The ring cover 111 is mounted on the upper side of the external member 108. The stopper 112 is mounted on the ring cover 111. It is possible to prevent the ring cover 111 from being fallen off from the rotation-regulating unit 100 via the stopper 112 which is engaged with the leg 90 inserted into the insertion hole 51*c*1.

When a pressing force in a rotating direction (i.e. a rotational torque) is applied to the second engaging part K2 via the first engaging part K1, it is transmitted to the intermediate member 105 from the external cylinder 110 via the engagement between the projections 110*a* and the recesses 106*a*. The present embodiment uses the spring 103 serving as a reaction generator, whereby the second engaging part K2 is restored to an initial position P0 (see FIG. 6) as long as a rotational torque is less than the predetermined value, and therefore reactive force will disappear. When a rotational torque becomes higher than the predetermined value, the projection 110*a* may overpass the peak 106*b* and then engage with the adjacent recess 106*a*, thus shifting the initial position P0 of the second engaging part K2. This action will be described in detail with reference to FIGS. 5A to 5D and FIG. 6.

FIGS. 5A to 5D diagrammatically show the relationship between window opening 107 of the intermediate member 105 and the first and second ends t1, t2 of the spring 103 when the second engaging part K2 receives a pressure from the first engaging K1 in a counterclockwise direction in a plan view. FIG. 6 is a plan view which is used to explain the rotation range of the external member 108.

FIGS. 5A to 5D show a pair of spring ends t11, t12 and a pair of grooves m11, m12 in addition to a pair of spring ends t1, t2 and a pair of grooves m1, m2 which are shown in FIG. 4. Herein, the spring ends t11, t12 and the grooves m11, m12 are related to a modified example of the rotation-regulating unit 100; hence, the details thereof will not be discussed below. Thus, the following description will be given solely with respect to the rotation-regulating unit 100 of FIG. 4.

Figure 5A:
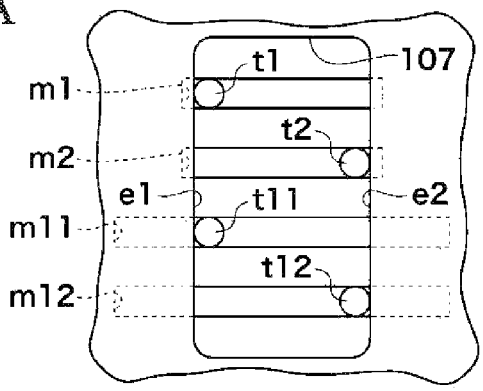
FIG. 5A is an illustration diagrammatically showing an initial position of a window opening in which the opposite ends of a spring are engaged with the grooves of an intermediate cylinder through the window opening in the rotation-regulating unit.
Figure 5B:
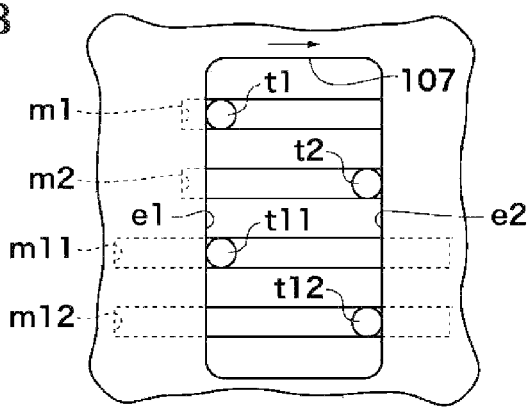
FIG. 5B is an illustration diagrammatically showing a first position of the window opening of the rotation-regulating unit.
Figure 6:
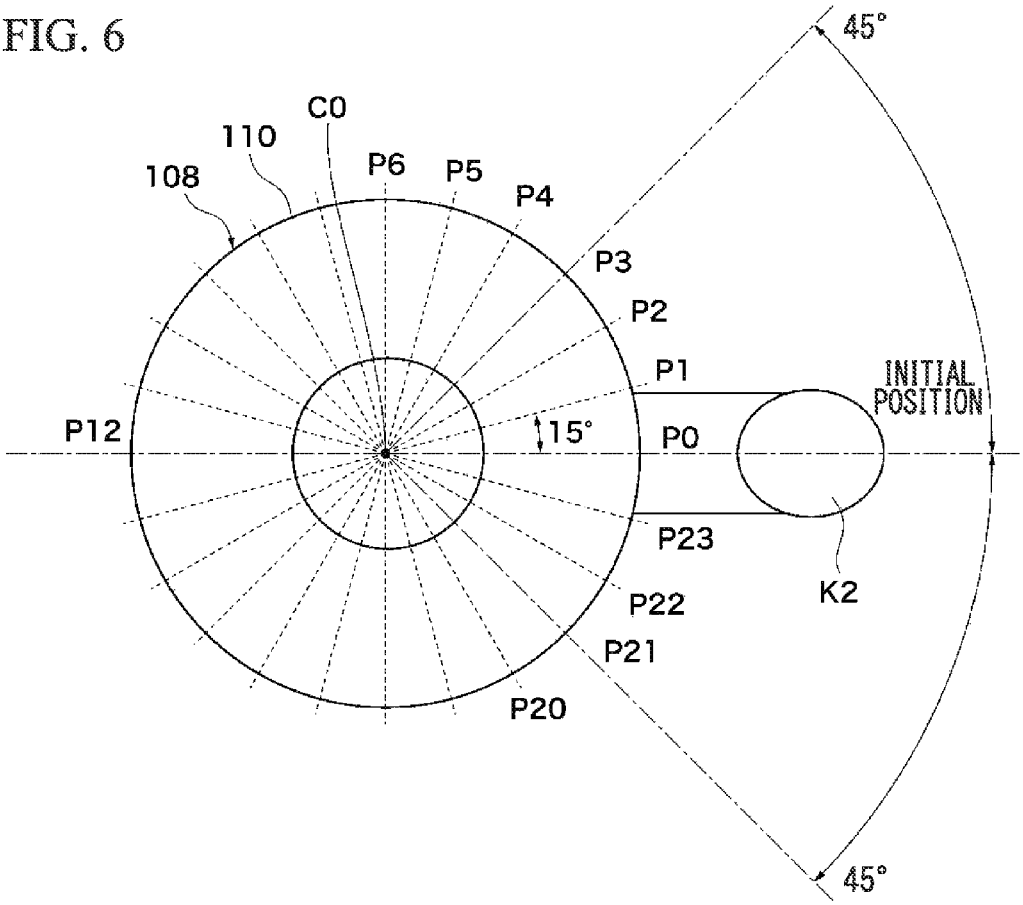
FIG. 6 is a plan view which is used to explain the rotation range of an external member in connection with the engaging part of the rotation-regulating unit.

FIG. 5A shows an initial position of the window opening 107 of the rotation-regulating unit 100 in which the intermediate member 105 and the second engaging part K2 are disposed at the initial position P0 (see FIG. 6), wherein the spring 103 is engaged with the window opening 107 of the intermediate member 105 such that the first end t1 comes in contact with the first driver e1 while the second end t2 comes in contact with the second driver e2. The second engaging part K2 receives a rotational torque in a counterclockwise direction in a plan view (i.e. a rightward direction in FIG. 5A), wherein the window opening 107 is displaced rightwards, and therefore the first and second ends t1, t2 of the spring 103 are correspondingly displaced rightwards. FIG. 5B shows a first position of the window opening 107 of the rotation-regulating unit 100 in which, due to rightward displacement of the spring 103, the second end t2 of the spring 103 comes in contact with the right end of the second groove m2 of the intermediate cylinder 51*b*. Subsequently, the second end t2 of the spring 103 is stopped in position while the first end t1 may be solely displaced, and therefore the horizontal distance between the first end t1 and the second end t2 is being reduced, thus causing a reactive force of the spring 103.

Figure 5C:
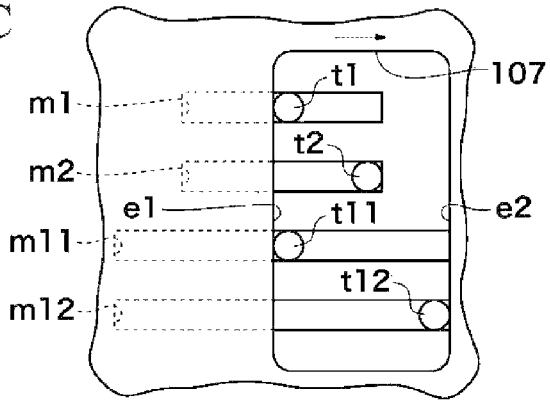
FIG. 5C is an illustration diagrammatically showing a second position of the window opening of the rotation-regulating unit.
Figure 5D:
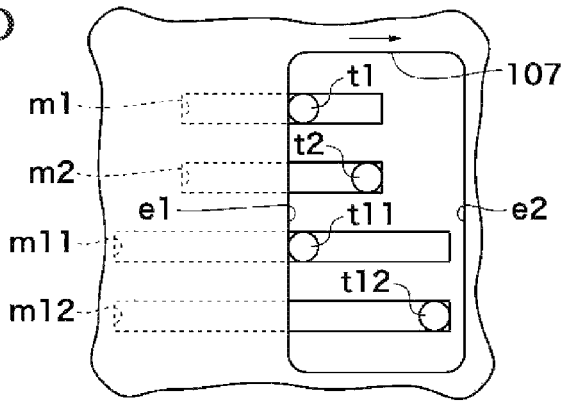
FIG. 5D is an illustration diagrammatically showing a third position of the window opening of the rotation-regulating unit.

The reactive force of the spring 103 may be proportional to the displacement of the window opening 107 in the middle of the displacement. FIG. 5C shows a second position of the window opening 107 of the rotation-regulating unit 100 in which the window opening 107 is further displaced rightwards, wherein the projection 110*a* is further forced to overpass the peak 106*b*, thus rapidly increasing the reactive force. FIG. 5D shows a third position of the window opening 107 of the rotation-regulating unit 100 in which the window opening 107 is further displaced rightwards, and therefore the projection 110*a* overpass the peak 106*b*.

Until the second position of the window opening 107 shown in FIG. 5C, the intermediate member 105 concurrently rotates together with the external member 108, wherein the spring 103 generates a reactive force which becomes larger as the rotational displacement of the second engaging part K2, which is displaced rightwards from the initial position P0, becomes larger. Until the third position of the window opening 107 shown in FIG. 5D, the second engaging part K2 can be returned to the initial position P0 due to a reactive force of the spring 103 upon releasing a pressing force applied to the rotation-regulating unit 100 in a rotating direction.

The third position of the window opening 107 shown in FIG. 5D corresponds to a position P3 in FIG. 6. That is, the foregoing positions of the window opening 107 shown in FIGS. 5A to 5D correspond to positions P0 to P3 respectively. For example, a rotation angle of 45° is set to an angle range between the positions P0 and P3. Herein, a rotational torque in a clockwise direction is symmetrical to a rotational torque in a counterclockwise direction, but they can be analyzed in a similar manner. When a rotational torque below the predetermined value is applied to the second engaging part K2 which is disposed at the initial position P0 relative to the leg 90, it is possible to regulate the rotational displacement of the second engaging part K2 within an angle-regulating range (i.e. ±45°). The function of the rotation-regulating unit 100 is implemented using the spring 103, the intermediate member 105, and the base 51.

Due to a large rotational torque which is increased such that the window opening 107 will overpass the third position of FIG. 5D, the external member 108 cannot follow up with the intermediate member 105, in other words, it becomes impossible to maintain the engagement between the projection 110*a* and the recess 106*a*, and therefore projection 110*a* will overpass the peak 106*b*. Thereafter, the second engaging part K2 will not be restored to the "original" initial position P0. That is, the initial position P0 will be shifted by a certain angle corresponding to the number of peaks 106*b* which the projection 110*a* overpasses.

Suppose that, due to a rotational torque above the predetermined value, the second engaging part K2 is displaced to the intermediate position between the position P3 and the position P4 since the projection 110 overpasses one peak 106*b*, and then the rotational torque is released. In this case, a "new" initial position is set to the position P1, which is shifted from the "original" initial position P0, and therefore the second engaging part K2 will be restored to the position P1. When a rotational torque is released after the second engaging part K2 is displaced to the intermediate position between the positions P5 and P6, a "new" initial position is set to the position P3.

In the present embodiment, the connecting part CN of the rotation-regulating unit 100 connects the external member 108 relative to the leg 90 in a rotatable manner. Upon receiving a pressing force due to an impact applied to the pad member pd, the second engaging part K2 of the external member 108 is displaced in a rotating direction from the initial position P0 together with the intermediate member 105, and therefore the spring 103 will generate a reactive force. When the pressing force is released, the second engaging part K2 is restored to the initial position P0, and therefore the reactive force will disappear. Thus, it is possible for the pad member pd to elastically absorb a rotational torque applied to the pad pd in a rotating direction. In particular, a rotation-regulating force becomes larger in response to a rotational torque in a rotating direction since a reactive force becomes larger as the rotational displacement of the second engaging part K2 becomes larger. Therefore, it is possible to suppress the occurrence of a failure or damage due to an excessive force in a rotating direction; hence, it is possible to restrain a player from feeling discomfort in striking the pad member pd with a stick.

When a rotational torque above the predetermined value is applied to the second engaging part K2 which is disposed at the initial position P0, the rotational displacement of the second engaging part K2 becomes larger than the predetermined regulation range, and therefore the regulation range of the rotation-regulating unit 100 will be shifted as shown in FIG. 6. Thereafter, when the rotational torque is released, the second engaging part K2 will be restored to the "newly shifted" initial position. Thus, it is possible to suppress the occurrence of a failure or damage due to a further large force applied to the pad member pd.

In the normal condition of performance in which a rotational torque applied to the second engaging part K2 is maintained below the predetermined value, it is possible to prevent the main strike area of the pad member pd from being unexpectedly changed since the rotational displacement of the second engaging part K2 is regulated within the regulation range (i.e. ±45°); hence, it is possible to prevent wiring cords from being unexpectedly caught by some parts of a percussion instrument.

The present embodiment uses one spring 103 exemplifying a reaction generator which generates a reactive force to a rotational torque applied to the second engaging part K2; but this is not a restriction. It is possible to arrange two or more springs in the rotation-regulating unit 100.

For example, it is possible to modify the rotation-regulating unit 100 as shown in FIGS. 5A to 5D. In a modified example, another pair of first and second grooves m11, m12 is formed on the external circumference of the intermediate cylinder 51*b* of the base 51 while a secondary spring having a pair of first and second ends t11, t12 is additionally arranged in the rotation-regulating unit 100. In this connection, the lengths of the first and second grooves m11, m12 are longer than the lengths of the first and second grooves m1, m2 in the opposite sides of a longitudinal direction.

In the modified example, the secondary spring starts to generate a reactive force at the second position of FIG. 5C in which the second end t12 comes in contact with the right end of the second groove m12. In the period of time in which the window opening 107 is moved from the initial position of FIG. 5A to the second position of FIG. 5C, the spring 103 is solely activated to generate a reactive force. After the second position of FIG. 5C, the secondary spring is additionally activated to generate a reactive force. This may increase the rate of increasing a reactive force against the rotational displacement (or the rotating angle) of the second engaging part K2 after the second position of FIG. 5C.

When the rotation-regulating unit 100 is modified such that the rate of changing a reactive force against the rotational displacement of the second engaging part K2 will be changed in a stepwise manner, it is possible to enhance a rotation-regulating function, thus further suppressing the occurrence of a failure or damage in a percussion instrument.

Figure 7A:
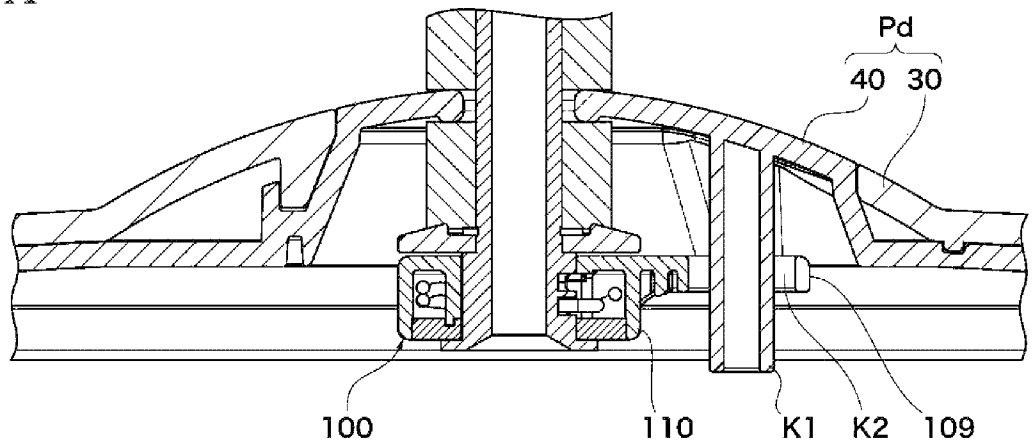
FIG. 7A is a cross-sectional view showing a first modified example regarding a pair of engaging parts which are engaged with each other in connection with a pad member in a percussion instrument.
Figure 7B:
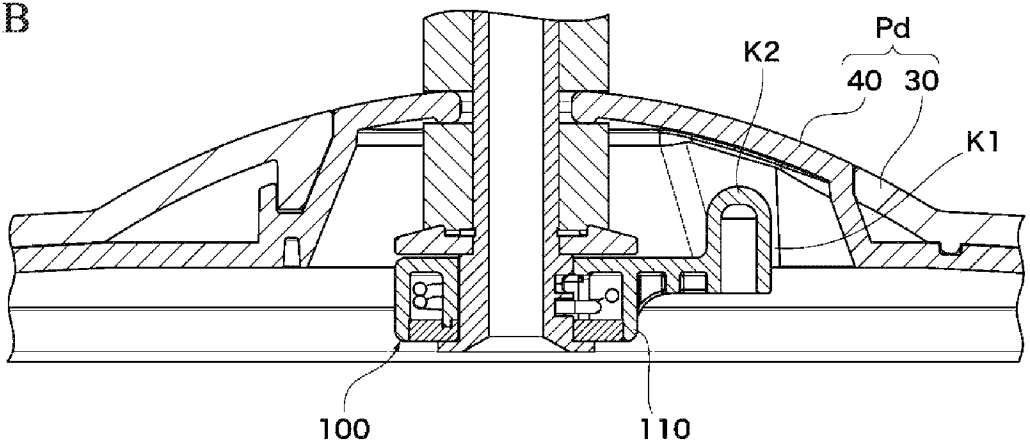
FIG. 7B is a cross-sectional view showing a second modified example regarding a pair of engaging parts which are engaged with each other in connection with a pad member in a percussion instrument.

The present embodiment is designed such that the second engaging part K2 is formed as a rod while the first engaging K1 is formed as a through-hole; but this is not a restriction. FIGS. 7A and 7B show modified examples regarding a pair of parts K1, K2 which are engaged with each other in connection with the pad member pd. That is, the present invention may employ any shapes of parts K1, K2 as long as a force applied to the pad member pd in a rotating direction is reliably transmitted from the first engaging K1 to the second engaging part K2.

FIG. 7A shows a first modified example in which the rod-shaped first engaging part K1 is suspended from the frame 40 while the second engaging part K2 serving as a through-hole is formed in an extended part 109 which is horizontally extended from the external cylinder 110 in the rotation-regulating unit 100. Herein, the first engaging part K1 is inserted into the second engaging part K2. FIG. 7B shows a second modified example in which the first engaging part K1 is formed using a wall instead of a through-hole below the frame 40 while the second engaging part K2 is projected upwardly from the external cylinder 110. Herein, the first engaging part K1 is engaged with the second engaging part K2 such that the second engaging part K2 is surrounded by the first engaging part K1.

Figure 8A:
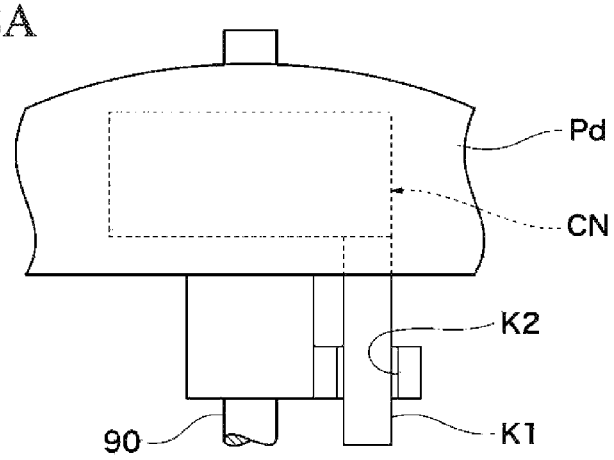
FIG. 8A is a side view partly in section showing a first modified example of a connecting part of the rotation-regulating unit.
Figure 8B:
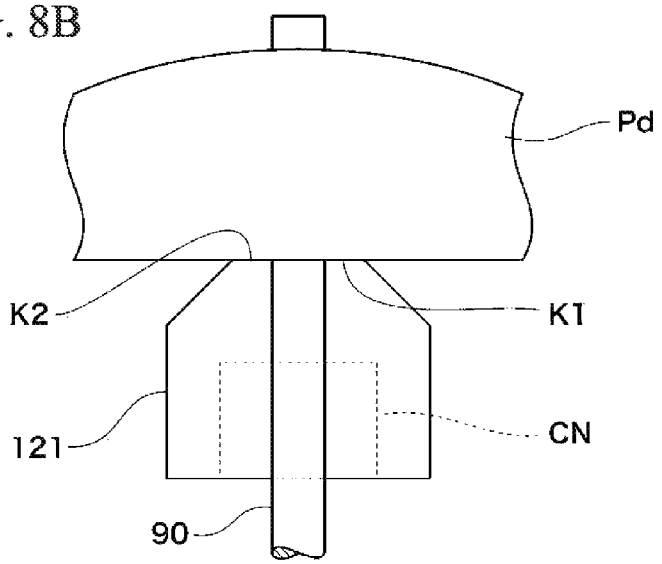
FIG. 8B is a side view partly in section showing a second modified example of the connecting part of the rotation-regulating unit.

In the present embodiment, the second engaging part K2 is connected to the leg 90 in a rotatable manner about the rotation center C0 via the connecting part CN furnished with a reaction generator and a rotation-regulating function; but this is not a restriction. FIGS. 8A and 8B show modified examples regarding the connecting part CN which is arranged at either the intermediate position between the second engaging part K2 and the leg 90 or the intermediate position between the first engaging part K1 and the pad member pd.

FIG. 8A shows a first modified example of the connecting part CN which is arranged in the pad member pd, wherein the "rod-shaped" first engaging part K1 is suspended from the connecting part CN. The first engaging part K1 is inserted into the second engaging part K2, such as a through-hole, which is formed in the leg 90. In the first modified example, the pad member pd and the first engaging part K1 are connected together via the connecting part CN in a rotatable manner about the rotation center C0.

FIG. 8B shows a second modified example of the connecting part CN, wherein the pad member pd is supported by a support member 121 which is connected to the leg 90 via the connecting part CN. The upper portion of the support member 121 is a wedge-shaped projection serving as the second engaging part K2. An elongated grooved recess serving as the first engaging part K1 is formed inside the pad member pd in correspondence with the wedge-shaped projection of the second engaging part K2, wherein the pad member pd can be rocked via the engagement between the first engaging part K1 and the second engaging part K2. In the second modified example, the leg 90 and the support member 121 are connected together via the connecting part CN in a rotatable manner about the rotation center C0.

A rotational torque applied to the pad member pd is transmitted from the first engaging part K1 to the second engaging part K2 and the support member 121. Owing to the operation of the connecting part CN, the support member 121 receives a reactive force against a rotational torque via the leg 90. Herein, the initial position should be shifted due to an excessive rotational torque applied to the pad member pd.

In this connection, it is possible to arrange the second engaging part K2 independently of the leg 90 or to unify the second engaging part K2 with the leg 90 on the condition that the connecting part CN does not need to be arranged in proximity to the leg 90 and the second engaging part K2. Additionally, it is possible to arrange the first engaging part K1 independently of the pad member pd or to unify the first engaging part K1 with the pad member pd on the condition that the connecting part CN does not need to be arranged in proximity to the pad member pd and the first engaging part K1.

Figure 8C:
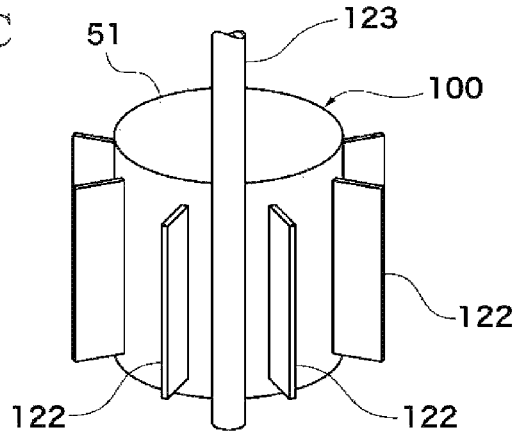
FIG. 8C is a perspective view showing a modified example of the rotation-regulating unit which uses a plurality of plate springs instead of a spring.

As the reaction generator installed in the rotation-regulating unit 100, it is possible to use any shapes or any materials, such as elastic materials other than the spring 103. FIG. 8C shows a modified example of the reaction generator which uses a plurality of plate springs 122. That is, the rotation-regulating unit 100 is modified to preclude the intermediate member 105 while arranging a plurality of plate springs 122 which are positioned along the external circumference of the base 51 at equal spacing and which are vertically projected in a radial manner. A vertical rod 123 is suspended from the external member 108 and interposed between a pair of plate springs 122 which adjoin with each other. When the external member 108 is rotated together with the vertical rod 123, a reactive force occurs due to the elasticity of the plate spring 122. An excessive rotational torque may increase the deflection of the plate spring 122, and then the vertical rod 123 will overpass the plate spring 122, thus shifting the initial position of the vertical rod 123 by an interval between the plate springs 122 which adjoin together.

Figure 9A:
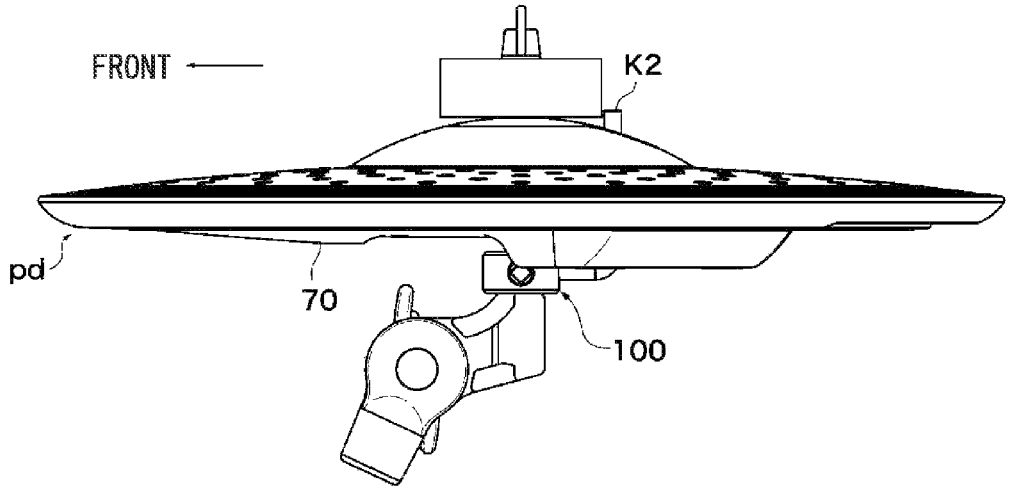
FIG. 9A is a side view of an electronic pad resembling a cymbal.
Figure 9B:
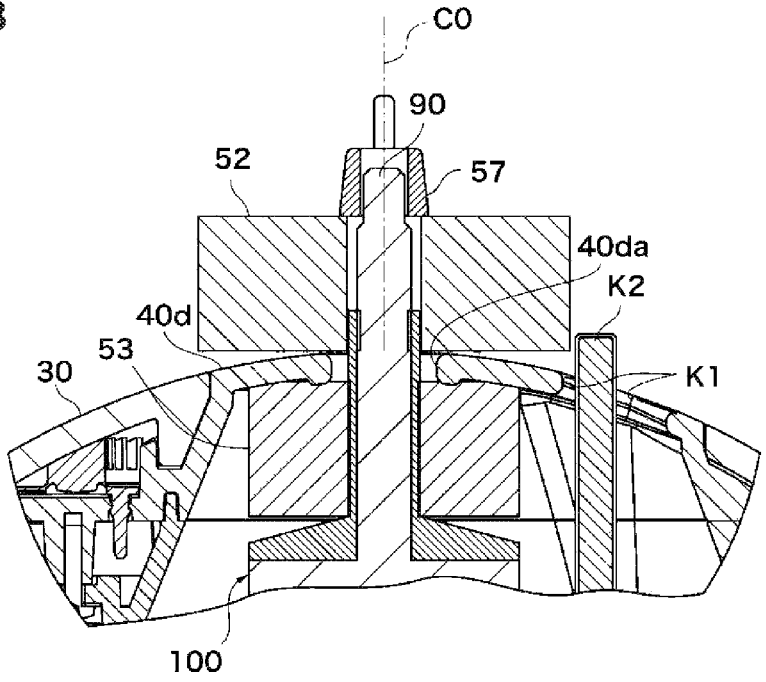
FIG. 9B is a cross-sectional view showing the center part of an electronic pad in a radius direction.

It is possible to redesign the present embodiment as an electronic pad resembling a cymbal as shown in FIGS. 9A and 9B. FIG. 9A is a side view of an electronic pad resembling an electronic cymbal, while FIG. 9B is a cross-sectional view showing the center part of the electronic pad in a radius direction.

In the electronic pad resembling a cymbal shown in FIGS. 9A and 9B, the pad member pd is supported by the leg 90 which is fixed in position. The felts 52, 53 and the nut 57 are slightly changed in shape in comparison with the foregoing parts used in a high-hat cymbal (see FIG. 1) although they have the same configurations and functions as the foregoing parts. The rotation-regulating unit 100 is fixed to the leg 90, and therefore the pad member pd is supported by the leg 90 in a rocking manner. An electronic pad resembling a cymbal may include a reaction generator and a rotation regulator which are equivalent to those installed in an electronic pad resembling a high-hat cymbal. In either case, the pad member pd is not necessarily formed in a disc shape; hence, the pad member pd can be formed in other shape such as fan-like shapes, semicircular shape, and elliptical shapes.

The rotation-regulating unit 100 implements the foregoing functionality by means of a reaction generator which generates a reactive force due to the rotational displacement of the second engaging part K2 from the initial position, and a rotation regulator which regulates the rotational displacement of the second engaging part K2 within the predetermined regulation range when a rotational torque less than the predetermined value is applied to the second engaging part K2; but this is not a restriction. That is, the rotation-regulating unit 100 needs to include either a reaction generator or a rotation regulator in order to suppress the occurrence of a failure or damage due to an excessive rotational force applied to an electronic pad.

Lastly, the present invention is not necessarily limited to the foregoing embodiment and variations, which can be further modified in various ways within the scope of the invention as defined by the appended claims. The technical features of the present invention can be summarized as follows.

(1) The present invention is characterized by arranging a rotation-regulating mechanism in a supporting structure for an electronic pad of a percussion instrument. The rotation-regulating mechanism has a coil spring which is formed in a circular shape wound about the rotation center of an electronic pad, wherein the opposite ends of a coil spring are brought into contact with a pair of drivers which are positioned relative to a pair of grooves via a window opening. The coil spring may generate a reactive force in the clockwise direction and in the counterclockwise direction. In this connection, it is possible to use other materials such as elastic materials (e.g. expanding materials, contracting materials) and deformable materials other than springs.

(2) The rotation-regulating mechanism is not necessarily arranged in proximity to an electronic pad but can be arranged in a supporting structure which is used to hold an electronic pad in connection with a stand or a pole. This may simplify the overall structure of an electronic pad, thus preventing an electronic pad from being unexpectedly damaged due to a heavy weight or a complex structure.

(3) The rotation-regulating mechanism is maintained at the initial position which is determined in advance irrespective of a small rotational torque applied to an electronic pad. Due to an excessive rotational torque applied to an electronic pad, the rotation-regulating mechanism is shifted from the initial position to the other position in a rotating direction. For example, the rotation-regulating mechanism can be automatically restored to the initial position as long as an electronic pad is rotated within the predetermined rotation range up to 45° deviated from the initial position in a rotating direction. In this connection, the rotation-regulating mechanism may automatically stop an electronic pad at the predetermined position even when an electronic pad is forced to be rotated by a certain angle or more.

(4) Due to an excessive rotational torque applied to an electronic pad which was already rotated by a certain angle, the rotation-regulating mechanism automatically changes the initial position. Due to a small rotational torque applied to an electronic pad, the rotation-regulating mechanism may automatically stop the rotation of an electronic pad. Due to a large rotational torque applied to an electronic pad, however, the rotation-regulating mechanism may allow an electronic pad from being further rotated in order to prevent an electronic pad from being damaged.

(5) The rotation-regulating mechanism may exert an intense force to restore the initial position as an electronic pad is further forced to rotate due to a further rotational torque.

(6) An electronic pad arranges a strike area at the predetermined position in relation to an impact sensor. The impact sensor detects an impact applied to the strike area of an electronic pad so as to generate an electric signal which is used to generate a musical sound. For this reason, it is necessary to maintain the positional relationship between the impact sensor and the strike area by means of the rotation-regulating mechanism because the impact sensor may fail to detect an impact applied to the strike area of an electronic pad which is further rotated beyond the rotation-regulating range.

(7) A percussion instrument includes a plurality of cords which are extended from an electronic pad and connected to an electronic pad. For this reason, it is necessary to regulate an electronic pad by means of the rotation-regulating mechanism because a further rotation of an electronic pad may cause cords to be unexpectedly caught by some parts of a percussion instrument.

(8) An electronic pad has a disk shape which is easy to rotate. A disk-shaped electronic pad may demonstrate a good appearance resembling an acoustic cymbal and a good balance of weight. In this connection, it is possible to employ other shapes such as elliptical shapes, fan-like shapes, and semicircular shapes other than disk-like shapes.

(9) It is possible to arrange an L-shaped rotation regulator, which is used to restore the electronic pad in position, in one of the supporting structure and the electronic pad while arranging an elliptical hole or a groove allowing for the insertion of the rod portion of an L-shaped rotation regulator in a rocking manner in the other of the supporting structure and the electronic pad. In this connection, the rotation regulator is not necessarily formed in an L-shape; hence, the rotation regulator can be formed in other shapes.

What is claimed is:

1. A supporting structure for an electronic pad of a percussion instrument, the supporting structure comprising:

a pad member configured to be struck;

a support member rotatably supporting the pad member about a rotation center so that the pad member is rotatable from an original position;

a first engaging part arranged independently of the pad member or unified with the pad member;

a second engaging part engaging the first engaging part, and arranged independently of the support member or unified with the support member, wherein the second engaging part is configured to rotate about the rotation center via the first engaging part in response to a rotary force applied to the pad member; and a connecting part that establishes at least one of a connection between the pad member and the first engaging part or a connection between the support member and the second engaging part, wherein the connecting part is configured to connect a supporting leg while enabling the second engaging part to relatively rotate about the rotation center, wherein the connecting part includes a reaction generator that generates a reactive force against the rotary force by which the second engaging part disposed at an initial position relative to the supporting leg is displaced from the initial position in a rotating direction, wherein, when the rotary force is released, the connecting part allows the second engaging part to be restored to the initial position using the reactive force generated by the reaction generator, wherein the reaction generator regulates a rotational displacement of the second engaging part within a predetermined regulation range of rotation of the second engaging part relative to the supporting leg from the initial position, so that the pad member returns to the original position due to the reactive force generated by the reaction generator, and wherein the regulation range is ±45°.

2. The supporting structure according to claim 1, wherein the reactive force becomes larger as a rotational displacement of the second engaging part from the initial position becomes larger.

3. A supporting structure for an electronic pad of a percussion instrument, the supporting structure comprising:

a pad member configured to be struck;

a support member rotatably supporting the pad member about a rotation center;

a first engaging part arranged independently of the pad member or unified with the pad member;

a second engaging part engaging the first engaging part, and arranged independently of the support member or unified with the support member, wherein the second engaging part is configured to rotate about the rotation center via the first engaging part in response to a rotary force applied to the pad member; and a connecting part that establishes at least one of a connection between the pad member and the first engaging part or a connection between the support member and the second engaging part, wherein the connecting part is configured to connect a first object and a second object to relatively rotate about the rotation center, wherein the connecting part includes a reaction generator that generates a reactive force against the rotary force by which the second object disposed at an initial position relative to the first object is displaced from the initial position in a rotating direction, and wherein, when the rotary force is released, the connecting part allows the second object to be restored to the initial position using the reactive force generated by the reaction generator;

a rotation-regulating unit that regulates a rotational displacement of the second object within a predetermined regulation range when a rotational torque less than a predetermined value is applied to the second object disposed at the initial position relative to the first object, wherein, when the rotational torque above the predetermined value is applied to the second object disposed at the initial position, the rotational displacement of the second object becomes higher than the predetermined regulation range, thus shifting the regulation range of the rotation-regulating unit, and wherein, when the rotational torque above the predetermined value is released, the rotation-regulating unit allows the second object to be restored to a new initial position that is shifted from the initial position.

4. A supporting structure for an electronic pad of a percussion instrument, the supporting structure comprising:

a pad member configured to be struck;

a support member rotatably supporting the pad member about a rotation center;

a first engaging part arranged independently of the pad member or unified with the pad member;

a second engaging part engaging the first engaging part, and arranged independently of the support member or unified with the support member, wherein the second engaging part is configured to rotate about the rotation center via the first engaging part in response to a rotary force applied to the pad member; and a connecting part that establishes at least one of a connection between the pad member and the first engaging part or a connection between the support member and the second engaging part, wherein the connecting part connects a first object and a second object to relatively rotate about the rotation center, wherein the connecting part includes a rotation-regulating unit that regulates a rotational displacement of the second object within a predetermined regulation range when a rotational torque less than a predetermined value is applied to the second object disposed at the initial position relative to the first object, wherein the second object is restored to the initial position when the rotational torque less than the predetermined value is released, wherein, when the rotational torque above the predetermined value is applied to the second object disposed at the initial position, the rotational displacement of the second object becomes higher than the predetermined regulation range, thus shifting the regulation range of the rotation-regulating unit, and wherein, when the rotational torque above the predetermined value is released, the rotation-regulating unit allows the second object to be restored to a new initial position that is shifted from the initial position.

5. The supporting structure according to claim 3, wherein the reactive force becomes larger as a rotational displacement of the second object from the initial position becomes larger.

* * * * *